US005492404A

United States Patent [19]

Smith

[11] Patent Number: 5,492,404

[45] Date of Patent: Feb. 20, 1996

[54] MIXING APPARATUS

[76] Inventor: William H. Smith, 163 Orchard Dr., McMurray, Pa. 15317

[21] Appl. No.: 739,228

[22] Filed: Aug. 1, 1991

[51] Int. Cl.[6] ..... B01F 5/00

[52] U.S. Cl. ..... 366/165.1; 366/167.1; 366/178.3

[58] Field of Search ..... 366/165, 167, 366/172, 173, 176–178, 336, 340, 101, 5, 11

[56] References Cited

U.S. PATENT DOCUMENTS

| | | | |
|---|---|---|---|
| 523,501 | 7/1894 | Adam et al. | 261/DIG. 7 |
| 2,747,844 | 5/1956 | Slayter | 366/178 |
| 3,409,274 | 11/1968 | Lawton | 366/340 |
| 4,085,463 | 4/1978 | Wilson | 366/177 |
| 4,087,862 | 5/1978 | Tsien | 366/165 |
| 4,154,537 | 5/1979 | Kress | 366/151 |
| 4,189,243 | 2/1980 | Black | 366/336 |
| 4,398,827 | 8/1983 | Dietrich | 366/165 |
| 4,474,477 | 10/1984 | Smith et al. | 366/165 |
| 4,519,423 | 5/1985 | Ho et al. | 366/178 |
| 4,585,353 | 4/1986 | Schönhausen | 366/196 |
| 4,761,077 | 8/1988 | Werner | 366/165 |
| 4,779,762 | 10/1988 | Klein et al. | 366/151 |
| 4,789,244 | 12/1988 | Dunton et al. | 366/160 |
| 4,954,147 | 9/1990 | Galgon | 366/177 |
| 5,131,757 | 7/1992 | Smith | 366/165 |
| 5,161,456 | 11/1992 | Ehrlinger et al. | 366/336 |

FOREIGN PATENT DOCUMENTS

| | | | |
|---|---|---|---|
| 1589306 | 5/1981 | United Kingdom | 366/151 |

*Primary Examiner*—David Scherbel
*Assistant Examiner*—James F. Hook
*Attorney, Agent, or Firm*—Ansel M. Schwartz

[57] ABSTRACT

A stripping apparatus comprising an elongated cylindrical outer jacket and an elongated inner cylinder surrounded by the outer jacket. The inner cylinder has an inner surface forming a stripping chamber and has an inlet at one end and an outlet at the other end. It has two portions of reduced outer diameter forming two separate channels and seal between the inner cylinder and outer jacket at the ends of said two separate channels. A plurality of parallel slots extend angularly through the two portions of reduced diameter in the direction of the outlet of the innner cylinder. Separate inlets extend through the outer jackets to the two separate channels for conducting different fluids under pressure or solids thereto.

5 Claims, 2 Drawing Sheets

MIXING APPARATUS

This invention relates to improvements in mixing or stripping apparatus.

BACKGROUND OF THE INVENTION

Mixing or stripping apparatus in the past have relied on the feed of air and liquid under atmospheric pressure, which pressure has been ineffective for thorough mixing. Also, such apparatus did not have the capability of mixing a number of liquid or dry materials under both atmospheric and high pressures.

SUMMARY OF THE INVENTION

An object of the present invention is to overcome the above-mentioned objection to present mixing or stripping devices by providing sources of high pressure for feeding air, liquid, and material particles and mixtures thereof to a mixing or stripping chamber so as to obtain more thorough mixing or stripping thereof.

DETAILED DESCRIPTION OF THE PREFERRED EMBODIMENT

Figure 1:
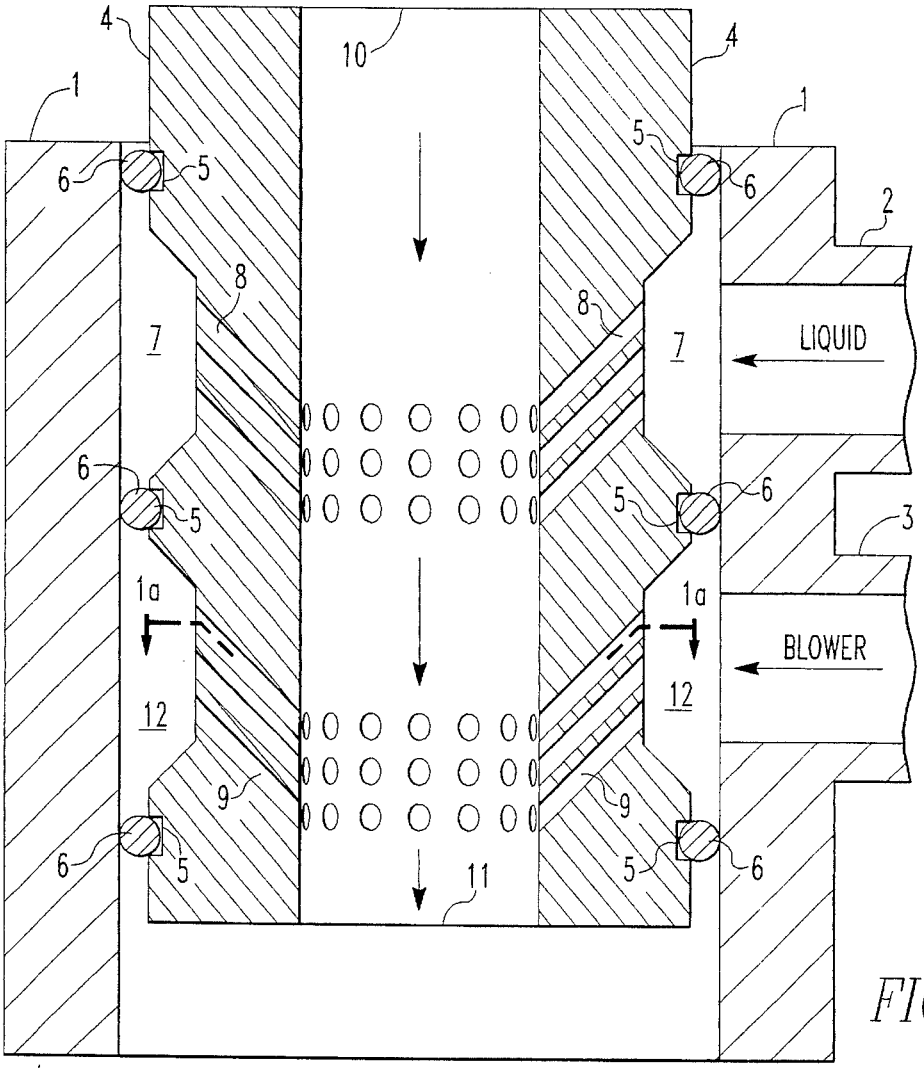
FIG. 1 is a vertical cross-section of a preferred embodiment of a stripping apparatus embodying the present invention.

In the following description of the drawings, like reference numerals refer to like parts in the different embodiments.

In FIG. 1 of the drawings, the stripping apparatus consists of two annular cylinders 1 and 4. The outer cylinder or jacket 1 has one or more inlet ports 2 through which liquidous media are introduced under pressure to the stripping apparatus. One or more material transport inlets 3 are also positioned in the outer cylinder. These inlets form the access to the apparatus through which liquids, solids, gases or any combination thereof can be introduced as needed to effectively strip the liquidous media.

The material transport inlet 3 is in communication with a blower 14 (FIG. 2) that enables the apparatus to receive a controlled amount of aeration independent of liquid velocity.

The blower 14 makes possible the injection and pre-atomization of matter into the stripping chamber for enhanced reaction. Matter may be solids, liquids, gases or any combination thereof.

Inserted into the outer jacket or cylinder 1 is a second annular cylinder 4. The bore of this cylinder is the stripping chamber. Annular slots 5 are provided around the circumference at both ends and at the center of cylinder 4 and at all separation points between liquidous media chambers and material transport chambers, which slots hold "O" rings 6. The "O" rings are in contact with the outer jacket cylinder 1 to seal against leakage of material from these components.

Stripping cylinder 4 is chamfered around its circumference in alignment with liquidous media port 2 forming a channel 7.

Figure 1A:
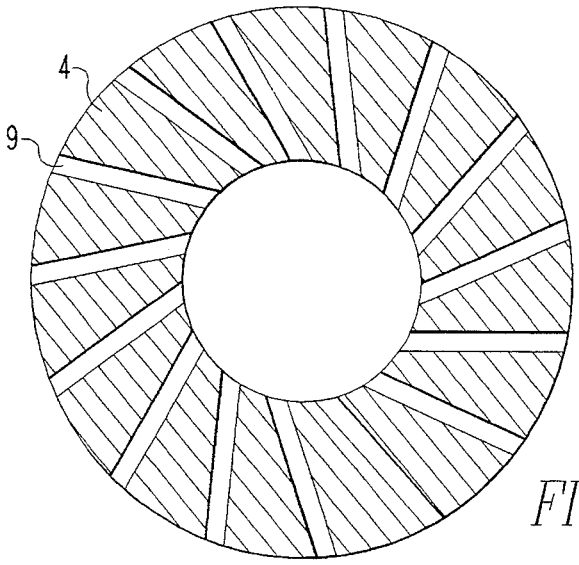
FIG. 1*a* is a cross-sectional view taken along line 1*a*—1*a* of FIG. 1.

A plurality of liquidous media inlet passages 8 are arranged in parallel in one or more rows around the circumference of the stripping cylinder within the channel formed by the chamfered area. The inlet passages 8 are directed forwardly toward the discharge end 11 of the stripping chamber 4 and are skewed at an angle relative the longitudinal axis of said stripping chamber 4, as shown in FIG. 1*a* so as to cause rotation of the liquidous media within the stripping chamber. The annular wall of the stripping chamber is of sufficient width to permit inlet passages 8 to be of proper length in relation to their diameter as will propel the liquidous media in jet-like streams into the stripping chamber.

Stripping cylinder 4 is chamfered around its circumference in alignment with blower media material transport inlet 3 forming a channel 12.

A series of material transport slots or holes 9 are arranged in one or more rows around the circumference of the stripping cylinder within channel 12 formed by chamfering. The slots are directed forwardly toward the discharge end 11 of the stripping chamber. Pre-atomized materials entrained into the blower airstream as mono-layers enter the stripping chamber through these slots and rapidly liquate in the turbulence caused by the jets of liquidous media and the infusion of aspirated air through the open throat 10 of the apparatus.

Although FIG. 1 shows a single chamber or channel 7 for liquidous media and a single chamber or channel 12 for blower entrained media, the intent of the invention is to use two or more chambers of either or both with the design dependent upon the particular application. For example, FIG. 2 shows three chambers or channels, the center one for a chemical, and FIG. 3 shows four chambers or channels including one for $O_2$.

Figure 2:
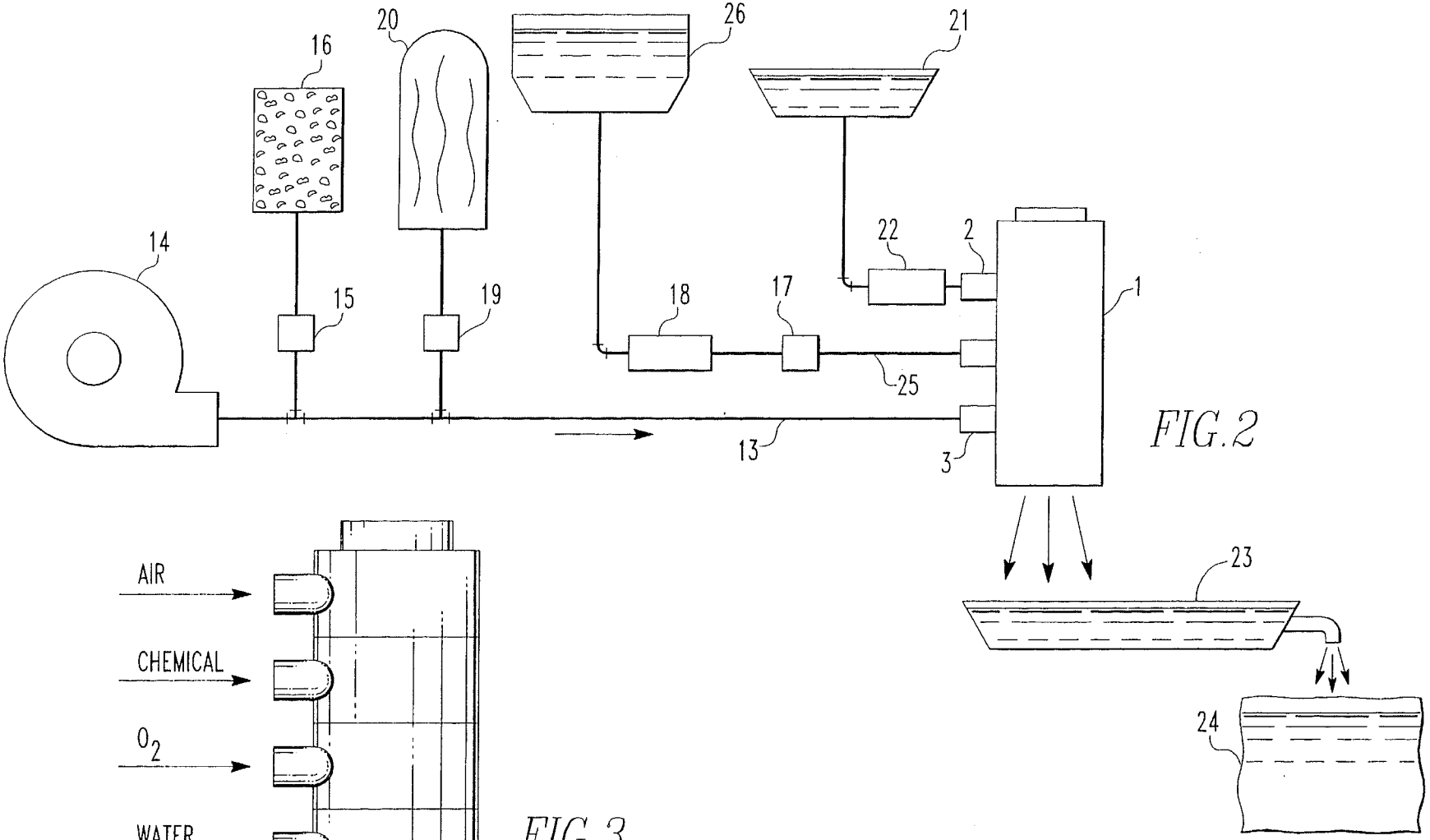
FIG. 2 shows a system for using the apparatus of FIG. 1 to strip contaminates from liquidous media.
Figure 3:
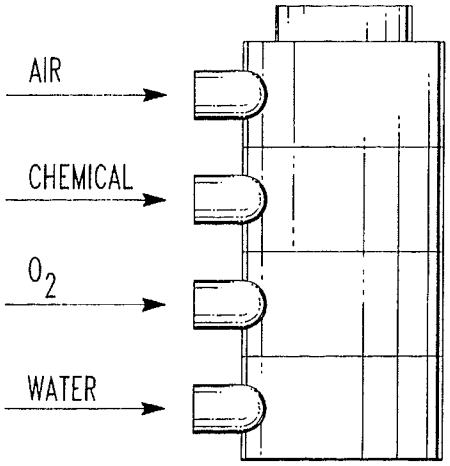
FIG. 3 shows a modification of FIG. 1 embodying a plurality of separate, stacked rings detachably connected together.

Referring to FIG. 2, numeral 13 denotes an inlet pipe into which a blower 14 feeds air under substantially greater than atmospheric pressure to material transport inlet 3 in the outer jacket 1 of the stripping cylinder. By opening valve 15 a fluidized bed 16 with a dry reagent is introduced into inlet pipe 13. By opening valve 17, a liquid reagent in tank 26 flows through metering pump 18 into inlet pipe 25 which leads to a central inlet and an additional channel similar to channel 7 or 12. By opening valve 19, gas in a container 20 is introduced into inlet pipe 13.

A liquid neutralizing agent in tank 21 may be fed by pump 22 through pipe 25 into inlet port 2.

The discharge end 11 of stripping chamber 4, as shown by the arrows, discharges material into a settling basin or tank 23 which eventually discharges into a river or stream 24.

As a modification, inlet pipe 13 may discharge into the liquidous inlet 2, whereas pump 22 may discharge into the material transport inlet 3. Also, selective amounts of dry reagent in tank 16 or liquid reagent from tank 26 or gas from container 20 or neutralizing reagent in tank 21 may be fed into inlet pipe 13.

FIG. 3 shows a modification of the stripping apparatus shown in FIG. 1 in the form of four separate annular chambers which may be either integral, as in FIG. 1, or in the form of separate, detachably interconnected annular chambers. The annular chambers receive, separately, air chemical, $O_2$ and water.

While I have illustrated and described several embodiments of my invention, it will be understood that these are by way of illustration only and that various changes and modifications are contemplated in my invention within the scope of the following claims:

I claim:

1. A stripping apparatus comprising: an elongated cylindrical outer jacket, an elongated inner cylinder surrounded by said cylindrical outer jacket, said inner cylinder having an inner cylindrical surface forming a stripping chamber having an air inlet comprising one end of said cylindrical surface and an outlet comprising the other end, said inner cylinder having, on an outer wall, two portions of reduced outer diameter forming two separate channels, sealing means between said inner cylinder and said outer jacket at the ends of each of said two separate channels, a plurality of parallel slots extending angularly through said two portions of reduced diameter in the direction of said outlet of said inner cylinder, said parallel slots being angularly skewed relative to the longitudinal axis of said inner cylinder, separate inlets extending through said outer jacket to said two separate channels and a blower to provide air continuously at greater than atmospheric pressure for continuously aerating a liquid provided to the stripping chamber through one of the inlets, said blower aerating said liquid independent from the flow of the liquid into the stripping chamber, said blower in fluidic communication with one of the inlets which is separate from the inlet which provides the liquid to the stripping chamber.

2. A stripping apparatus as recited in claim 1 said two portions of said inner cylinder are chamfered and wherein one of said separate inlets is connected to a source of liquid under substantially greater than atmospheric pressure and the other of said separate inlets is connected to a source of airborne solid material particles under pressure substantially greater than atmospheric and blown by said blower.

3. A stripping apparatus as recited in claim 1 together with a an open body of water into which said outlet of said stripping chamber discharges.

4. A stripping apparatus as recited in claim 1 wherein said two portions of reduced outer diameter are separate, instead of integral, and are detachably interconnected.

5. A stripping apparatus as recited in claim 4 wherein two additional detachably interconnected portions of reduced outer diameter are provided for introducing other fluid materials.

* * * * *